US008567487B2

(12) United States Patent
Christensen et al.

(10) Patent No.: US 8,567,487 B2
(45) Date of Patent: Oct. 29, 2013

(54) SECTIONED FLOW DEVICE

(75) Inventors: Rolf Christensen, Veberöd (SE); Tommy Norén, Veberöd (SE)

(73) Assignee: Alfa Laval Corporate AB, Lund (SE)

( * ) Notice: Subject to any disclaimer, the term of this patent is extended or adjusted under 35 U.S.C. 154(b) by 1084 days.

(21) Appl. No.: 12/518,670

(22) PCT Filed: Dec. 13, 2007

(86) PCT No.: PCT/SE2007/001111
§ 371 (c)(1),
(2), (4) Date: Jul. 10, 2009

(87) PCT Pub. No.: WO2008/076039
PCT Pub. Date: Jun. 26, 2008

(65) Prior Publication Data

US 2010/0012310 A1 Jan. 21, 2010

(30) Foreign Application Priority Data

Dec. 19, 2006 (SE) ..... 0602767

(51) Int. Cl.
*G05D 23/00* (2006.01)
*B01J 10/00* (2006.01)
*B01J 19/00* (2006.01)

(52) U.S. Cl.
USPC ..... 165/287; 422/129; 422/130; 422/198

(58) Field of Classification Search
USPC ..... 165/201, 274, 287; 126/561, 563, 640; 422/129, 130, 198, 202
See application file for complete search history.

(56) References Cited

U.S. PATENT DOCUMENTS

| | | | | | |
|---|---|---|---|---|---|
| 4,153,955 | A | * | 5/1979 | Hinterberger | 126/561 |
| 4,621,613 | A | * | 11/1986 | Krumhansl | 126/563 |
| 4,664,177 | A | * | 5/1987 | Edelstein | 165/274 |
| 4,671,253 | A | * | 6/1987 | Blount, Sr. | 126/640 |
| 4,750,543 | A | * | 6/1988 | Edelstein | 165/274 |
| 4,917,173 | A | * | 4/1990 | Brown et al. | 165/274 |
| 5,304,354 | A | * | 4/1994 | Finley et al. | 422/130 |
| 7,118,917 | B2 | * | 10/2006 | Bergh et al. | 422/130 |

(Continued)

FOREIGN PATENT DOCUMENTS

| | | |
|---|---|---|
| DE | 19518323 A1 | 11/1996 |
| EP | 0578218 A2 | 7/1993 |

(Continued)

*Primary Examiner* — Ljiljana Ciric
(74) *Attorney, Agent, or Firm* — MKG, LLC

(57) ABSTRACT

A heat exchanger plate includes one or more heat exchanger sections, each of which has an inlet and outlet. The heat exchanger sections flow one or more heat exchanger fluids therein in a first direction from the inlet to the outlet. The heat exchanger plate includes one or more process flow channels, each of which has a channel inlet point and a channel outlet point defining a line oriented in a second direction. The second direction is at an angle of ninety degrees relative to the first direction. The process flow channel is configured to flow a process fluid therein or thereon and has a serpentine configuration. The heat exchanger plate includes a temperature sensor. The heat exchanger plate includes a regulating valve positioned in each heat exchanger outlet and is configured to regulate flow of the heat exchanger fluid in response to a signal received from the temperature sensor.

4 Claims, 5 Drawing Sheets

(56) References Cited

U.S. PATENT DOCUMENTS

| | | | | |
|---|---|---|---|---|
| 7,122,156 | B2 * | 10/2006 | Bergh et al. | 422/129 |
| 7,141,217 | B2 * | 11/2006 | Karlsson et al. | 422/130 |
| 7,150,994 | B2 * | 12/2006 | Bergh et al. | 422/130 |
| 7,256,044 | B2 * | 8/2007 | Karlsson et al. | 422/129 |
| 7,267,987 | B2 * | 9/2007 | Bricker et al. | 422/129 |
| 7,537,739 | B2 * | 5/2009 | Haas et al. | 422/129 |
| 7,771,664 | B2 * | 8/2010 | Ashe et al. | 422/198 |
| 7,771,881 | B2 * | 8/2010 | Kim et al. | 422/198 |
| 7,867,458 | B2 * | 1/2011 | Haas et al. | 422/129 |
| 8,323,589 | B2 * | 12/2012 | Hamby et al. | 422/198 |
| 8,383,050 | B2 * | 2/2013 | Haas et al. | 422/129 |
| 2003/0203251 | A1 | 10/2003 | Brundage et al. | |
| 2006/0194084 | A1 * | 8/2006 | Kim et al. | 422/198 |
| 2013/0055896 | A1 * | 3/2013 | Lavric et al. | 422/129 |

FOREIGN PATENT DOCUMENTS

| | | | |
|---|---|---|---|
| EP | 1625887 | A1 | 2/2006 |
| GB | 2354960 | A | 11/2001 |
| JP | 5118728 | A | 5/1993 |
| WO | 2004052526 | A1 | 6/2004 |
| WO | 2006120026 | A2 | 11/2006 |

* cited by examiner

SECTIONED FLOW DEVICE

FIELD OF THE INVENTION

The present invention relates to a sectioned flow device such as a sectioned heat exchanger plate, a sectioned plate reactor or a sectioned flow module, and a method for regulating the temperature in a sectioned heat exchanger, sectioned flow module or sectioned plate reactor.

BACKGROUND OF THE INVENTION

In the use of continuous reactors, the results are controlled inter alia by the temperature, i.e. for certain applications it is important to maintain the temperature at an appropriate level for an appropriate period of time. It is also advantageous to be able to regulate the temperature in such a way that different steps in a sequence can take place in different temperature conditions and in a controlled manner. For plate reactors or flow modules intended to be usable for a plurality of purposes, this degree of flexibility is highly desirable.

It is therefore an object of the present invention to provide flexible regulation of the temperature in a heat exchanger, flow module or plate reactor.

Another object of the present invention is to control exothermic and endothermic reactions in a continuous heat exchanger, plate reactor or flow module.

A further object is to provide a heat exchanger, plate reactor or flow module which is flexible.

SUMMARY OF THE INVENTION

The present invention proposes a solution which makes it possible, for example, for a plurality of reactions to take place continuously by various reactants being injected at a plurality of points along the flow channel. Controlling the respective reactions and the formation of products and by-products entails the temperature being controlled to prevent unwanted reactions and promote desired reactions. The reactions are therefore conducted in a controlled manner by local cooling and heating of the process flow in the flow channel. In a flow module or plate reactor which has mixing zones, the flow channel may run in a serpentine path, which may be two-dimensional or three-dimensional. Examples of two-dimensional flow channels are to be found in PCT/SE2006/00118 and examples of three-dimensional flow channels in WO 2004/045761. The flow channel may for example be tubular or may take the form of a flow space. The flow channel may according to this embodiment have mixing elements, e.g. static mixing elements which constitute mixing zones, and an example of such a flow channel is described in PCT/SE 2006/001428 (SE 0502876-6).

Along the flow channel, samples may be taken, intermediate products may be taken out and later returned to the process flow, the temperature may be monitored along the channel, etc. Flow channels such as are exemplified in PCT/SE2006/00118, PCT/SE2006/001428 and WO 2004/045761 are cooled and heated by sectioned heat exchanger zones which may be sectioned heat exchanger plates or whole heat exchanger plates situated adjacent to the reactor plates or the flow plates. It has surprisingly been found that by altering the direction of flow on the heat exchanger plate or the utility plate by 90° it is possible to create a multiplicity of zones which in cross-flow relative to the main direction of flow divide the process flow into zones which may be differentiated temperature zones, i.e. each zone having its own temperature range. Having the heat exchanger zones at 90° relative to the main direction of flow may cause the heat exchanger fluids to flow in cross-flow, counterflow or co-flow relative to the flow in the flow channel or flow space. The pattern of flow depends partly on the size distribution of the zones relative to the flow channel or flow space. These heat exchanger zones divide the flow channel, flow module or plate reactor into sections which may be heated and cooled independently of one another. The present invention therefore affords advantages which can be achieved with the new sectioned heat exchanger zones, which means that the temperature can be better regulated and controlled and the process yield and product quality can thereby be improved. With the present invention, the flexibility can be increased by the possibility of different sections of the heat exchanger plate, flow module or plate reactor being used with different heat exchanger fluids, making it possible to increase the available temperature range. By increased flexibility it is possible to recover heat between the various sectioned zones, since, for example, the heat exchanger fluids may be recirculated in order, for example, to recover heat from, for example, a cooling section, or vice versa. A larger available temperature range makes it possible to alter reaction times by increased process flow velocity etc.

The aforesaid and other objects are achieved according to the invention by having the sectioned heat exchanger plate, sectioned flow module or sectioned plate reactor described in the introduction comprise one or more heat exchanger sections and one or more regulating valves, which regulating valves are connected to the inlet of each heat exchanger section or to the outlet of each heat exchanger section or to the inlet and outlet of each heat exchanger section, each heat exchanger being at an angle of 90° relative to a main direction of flow for a process flow in said sectioned heat exchanger plate, relative to a main direction of a process flow in said sectioned flow module or relative to a main direction of a process flow in said sectioned plate reactor.

The sectioned heat exchanger plate may be stacked and connected to a similar flow plate or reactor plate to form various temperature zones of the flow channel. The sectioned heat exchanger zones in the flow module or plate reactor may also divide the flow channel or reactor channel into various temperature zones by the use of heat exchanger plates to separate the plates in the flow module or plate reactor so that whole plates where the flow channel runs constitute one temperature zone and another whole plate constitutes another temperature zone. To provide regulation of the flow in the heat exchanger zones, either the inlet or the outlet of each heat exchanger zone is connected to a valve which regulates the flow through each heat exchanger zone, which means that each zone has its individual flow regulated with respect to the temperature and the heat exchanger fluid used in the respective heat exchanger zone.

To control the flow of heat exchanger fluids or the temperature in the zone, at least one control unit may be connected to sensor units or thermocouples, e.g. for recording of the temperature in the process flow, and valves may be connected to the control unit or units, which units control each valve. The measurement of the temperature may be by, for example, thermocouples or sensors, e.g. chemical sensors. The sensors may give a temperature value but other parameters may also be measured or recorded by means of sensors. The process can thus be monitored and/or measured, resulting in measured values which may serve as a basis for control of the process by regulating the optimum effect of the heat exchanger fluids. These thermocouples or sensors may be provided at the inlet of each heat exchanger section or the outlet of each heat exchanger section or at the inlet and outlet of each heat exchanger section, in one or more flow channels in said flow plate, said sectioned flow module or said sectioned plate reactor, or the thermocouples or sensors may be situated on the outlet side of the regulating valves, or combinations thereof.

According to an alternative embodiment of the invention, a thermocouple or a sensor is provided at the outlet of the flow channel in each plate or section. The information from the thermocouple or sensor then controls the flow valve connected to the flow channel, which valve then regulates the flow. The heat exchanger flow may also be regulated by individual regulating valves, e.g. modulating valves, solenoid valves, diaphragm valves, direct-acting valves, thermostatic valves or spherical sector rotary butterfly valves. Certain reactions require rapid regulation of flows to prevent the reaction sequence being affected by delayed cooling through the material, e.g. in an exothermic sequence, the purpose being to prevent damage etc., where it may be advantageous to apply regulation by magnet-controlled valves. In the case of endothermic reactions, other valves may be advantageous where these reactions require heat.

The valves are controlled by the temperature measured at the inlet or the outlet, before the valve or after the valve or at a plurality of points, depending on the type of reaction and the reaction conditions which occur in the specific chemical method or the process. The result of the measurement is converted to a measurement signal. The measurement signal can then be recorded, modulated, controlled etc. in order to control the connected valves. The measurement signal may be converted to a frequency signal which can be modulated to provide frequency-modulated pulse regulation. This frequency-modulated pulse regulation may be advantageous where thermic inertia occurs. There may be such inertia in the heat exchanger unit or on the heat exchanger medium side, or both, and in the flow module or plate reactor. Frequency-modulated pulse regulation makes it possible to use valves of an "on/off" type for modulating regulation. The valves may be regulating valves which may be selected from the group of valves which comprises modulating valves, solenoid valves, diaphragm valves, direct-acting valves, thermostatic valves and spherical sector rotary butterfly valves.

The present invention also relates to a method for regulating the temperature in a flow module or plate reactor, in which the flow module or plate reactor comprises one or more sectioned heat exchanger zones and the method comprises recording of the temperature in the process flow by means of thermocouples or sensors, e.g. chemical sensors, modulation of the recorded signals from the sensors or thermocouples, and control of the valves connected to the heat exchanger fluids. The method according to the invention may also comprise input of reactants to the process flow at at least one inlet along the flow channel, which process flow runs in cross-flow, counterflow or co-flow relative to the heat exchanger fluids in the sectioned heat exchanger plates, with recording of the temperature after the input of reactants. The method according to the invention may also comprise the possibility of the heat exchanger sections being at an angle of 90° relative to a main direction of flow for a process flow in at least one flow plate or relative to a main direction of flow for a process flow in said sectioned flow module or relative to a main direction of flow for a process flow in said sectioned plate reactor. The method may also comprise recording of the temperature after the input of reactants.

Preferred embodiments of the present invention are described below in more detail with reference to the attached schematic drawings, which depict only the features necessary for understanding the invention.

DETAILED DESCRIPTION OF THE DRAWINGS

Figure 1:
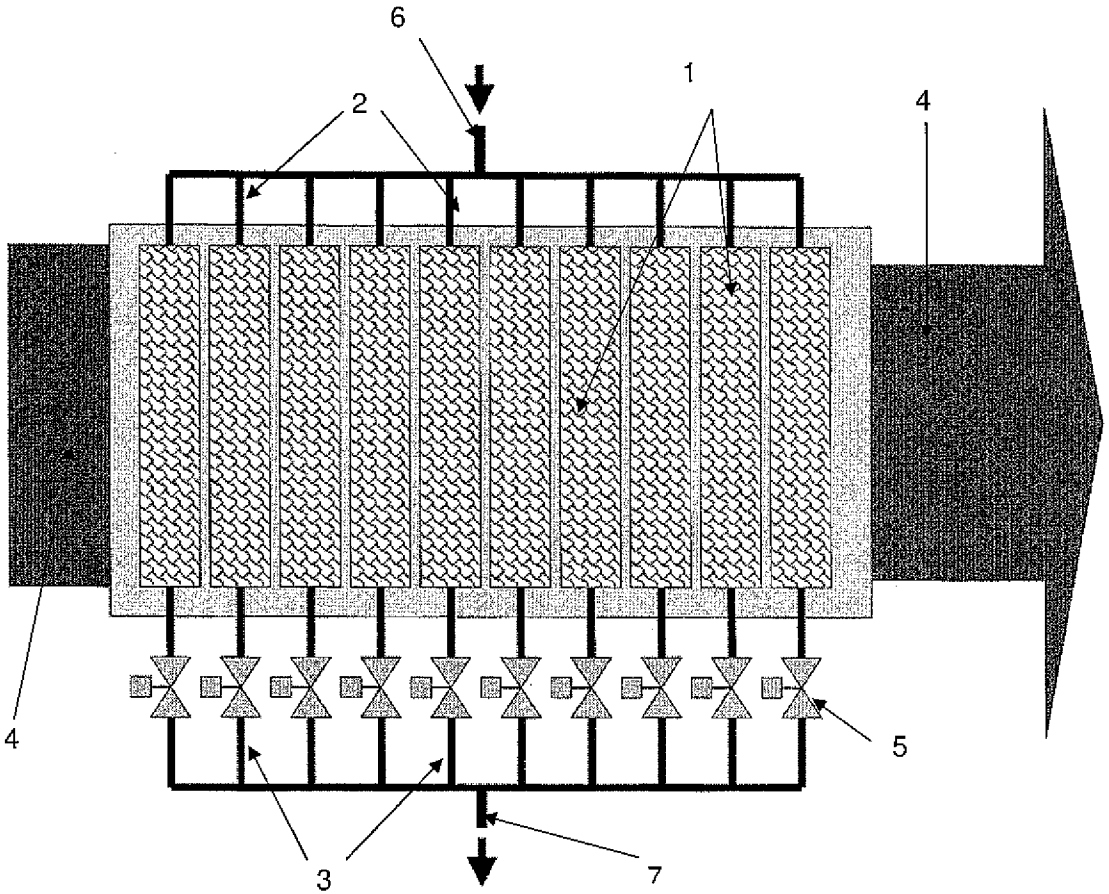
FIG. 1 depicts a sectioned heat exchanger plate according to the invention, as seen from above

FIG. 1 depicts a sectioned heat exchanger plate according to an embodiment according to the present invention. The diagram depicts the heat exchanger plate as seen from above, which is divided into a plurality of parallel sections. The flow in the heat exchanger plate according to this embodiment is at an angle of 90° relative to the main flow of the process, here represented by a large grey arrow indicated by element number 4 in FIG. 1. In each section the heat exchanger fluids may flow in cross-flow, co-flow or counterflow relative to the flow in the flow channel, which is on flow plate or the reactor plate, but the total flow or the main flow of the process flows in cross-flow. Heat exchanger fluids are put into each section 1 via the respective inlets 2. The heat exchanger fluids have according to this embodiment the same inlet temperature. For differentiation of the inlet temperature in the various sections, it is necessary that the fluids be taken from different sources at different temperatures, which is not illustrated in FIG. 1, but if the combined inlet 6 is instead replaced by the separate inlets 2 and the latter are separately connected to different media or different sources of heat exchanger fluids which are at different temperatures, a differentiation of the inlet temperature can be provided between the different sections in the sectioned heat exchanger plate. Another way of differentiating the temperature in the various sections is to regulate the flows in the various sections, which may be effected by means of valves 5 situated either before the inlets 2 or after the outlets 3 (in FIG. 1 the valves are situated after the outlets 3). The outlets 3 may be connected to a manifold 7 in which the heat exchanger fluids are brought together, but it is possible to have the outlets 3 lead to some inlet for further heat exchange, e.g. in a further heat exchanger zone, where remaining heat may be utilised.

Figure 2:
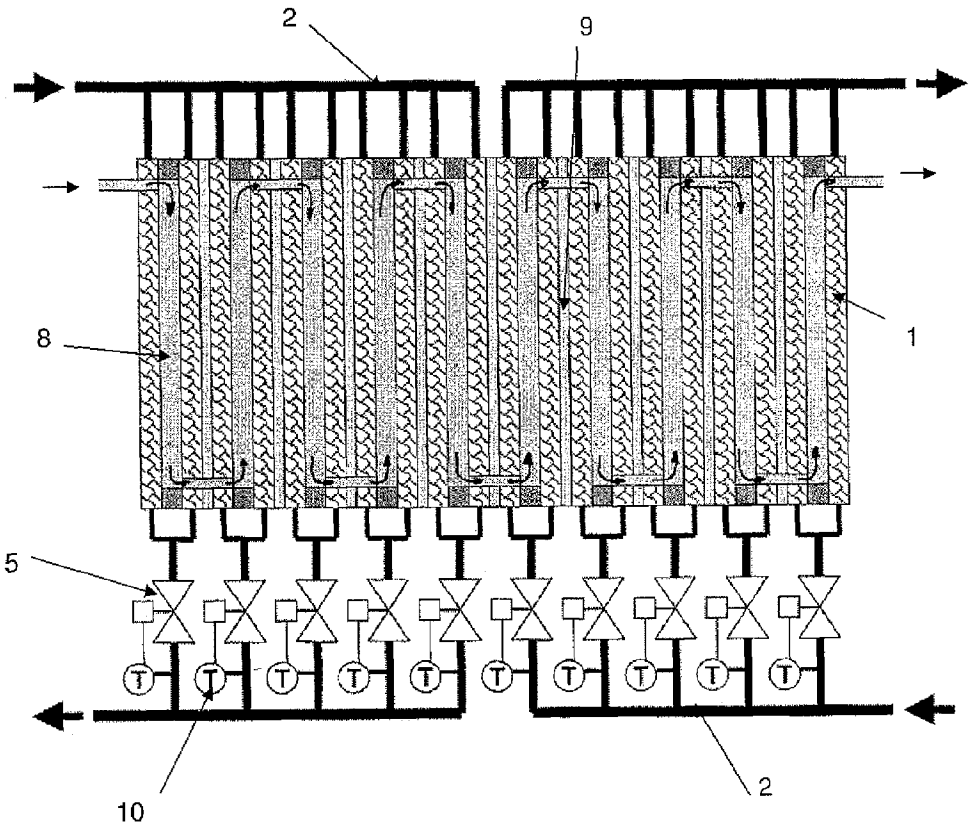
FIG. 2 depicts a sectioned flow module or plate reactor, as seen from the side, in an alternative embodiment according to the invention

FIG. 2 depicts an alternative embodiment according to the present invention, showing a reactor or flow module. The flow in the heat exchanger plates according to this embodiment is at an angle of 90° relative to the main flow of the process, here represented by two small black arrows (in and out) on each side of the module or reactor. This diagram depicts a flow module or plate reactor which has between each flow plate 8 or reactor plate 8 one or more heat exchanger plates 1 which may be sectioned or non-sectioned. The flow module or plate reactor is seen from the side. According to this embodiment, two heat exchanger plates 1 are separated by an insulating plate 9. FIG. 2 also shows how the valves 5 may be situated either on the inlet side or on the outlet side of the heat exchanger plates. According to the embodiment in FIG. 2, the heat exchanger plates are sectioned by at least one valve 5 being connected to each plate to regulate the heat exchanger medium. Thermocouples 10 may be connected either after the valves 5 after the outlet for the heat exchanger medium or before the outlet in the heat exchanger, or thermocouples 10 may be provided both at the outlet of the heat exchanger and on the outlet side of the valve (only the provision of thermocouples 10 on the outlet side of the valves is depicted in FIG. 2). The temperature recorded by the thermocouples then controls the valves which regulate the flow through the respective heat exchangers, thereby making it possible to provide pulse regulation which may be such that the temperature varies within a range or such that a continuously uniform temperature is maintained.

Figure 3:
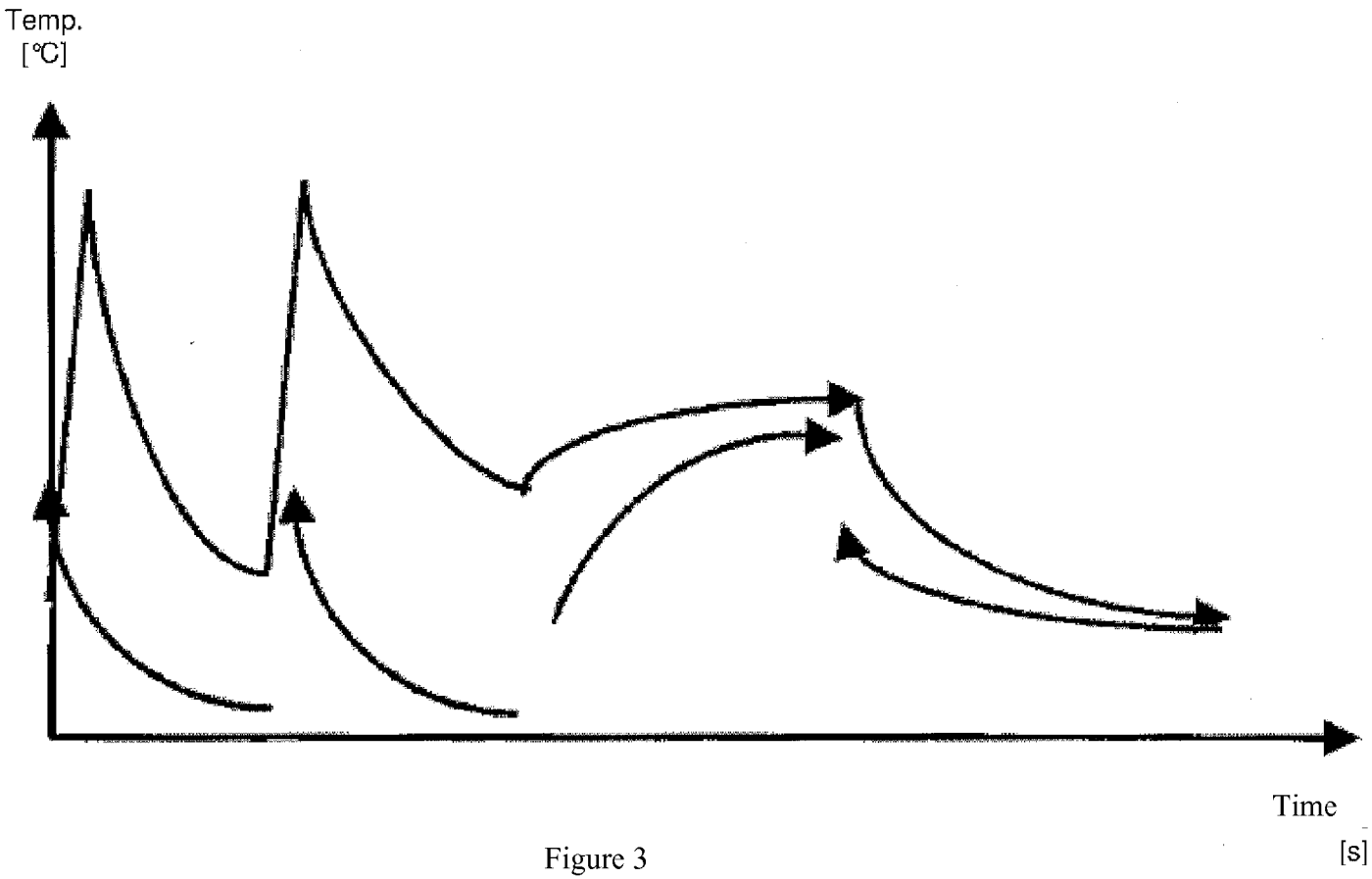
FIG. 3 depicts a pulsed regulation of the temperature according to the present method.

FIG. 3 depicts a time/temperature diagram for a method in which the temperature is regulated. The regulation of the temperature is based on a measurement signal providing information about whether the temperature at the measuring point has risen or fallen from the predetermined temperature, and the processing of such a signal leads to a signal being sent to the regulating valve or valves so that the flow is regulated by the latter being opened for a larger flow or constricted for a smaller flow. Since chemical reactions do not take place uniformly, the flow of the heat exchanger media will vary according to the measurements which are continuously made in order to achieve as advantageous a temperature effect as possible on the reaction flow.

Figure 4:
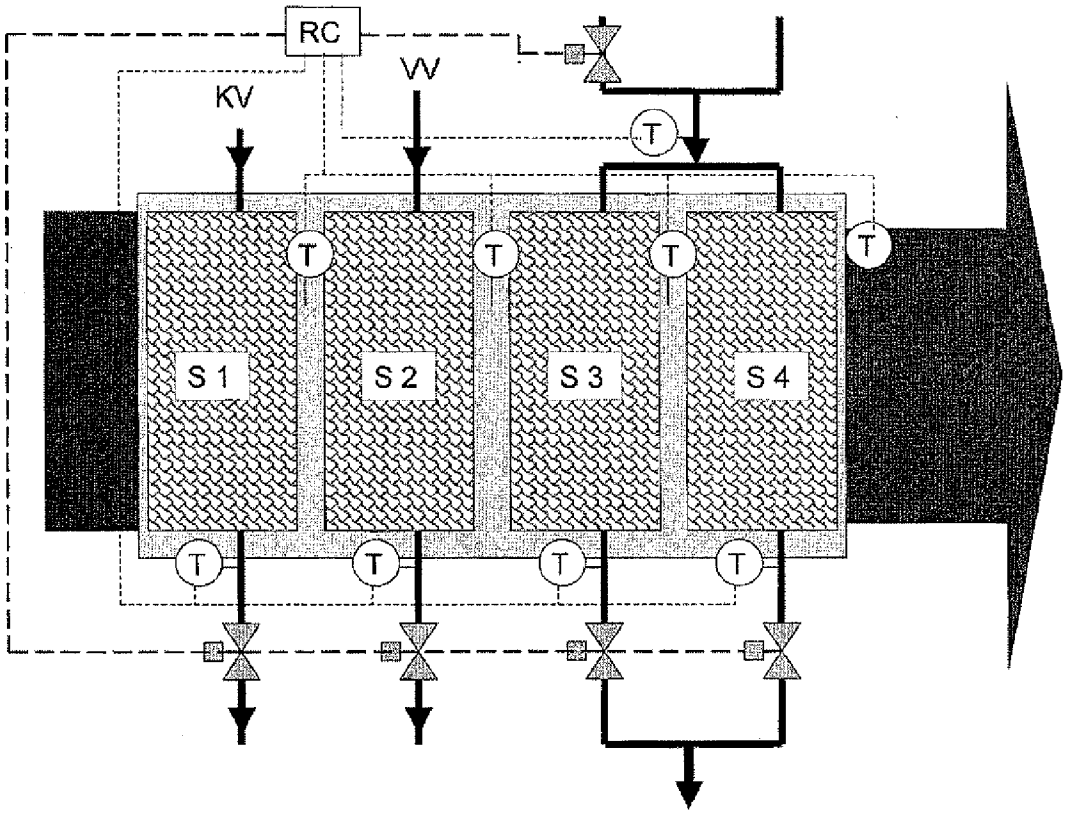
FIG. 4 depicts a further embodiment of the present invention.

According to the embodiment in FIG. 4, a regulating centre (RC in the diagram) uses measured values from thermocouples situated both at the inlet or outlet of the flow channel of each section S1, S2, S3 and S4 and at the inlet and outlet of heat exchanger fluids from each section. The diagram shows only temperatures measured by thermocouples (T in the diagram). The recording in the regulating centre may also be based on values from sensors which directly or indirectly measure the process results, i.e. portions of the reaction or side-reactions which are used for controlling the process. Regulation according to the embodiment depicted in FIG. 4 may also be used both to start and stop reactions in different sections and to control the reactions. Being able to mix warm and cold heat exchanger fluids (VV and KV respectively in the diagram) makes it possible to achieve flexibility in both regulating function and plant design. This flexibility makes it possible to adapt the heat exchange to different processes, but also to the heat exchanger, flow module or reactor used.

Figure 5:
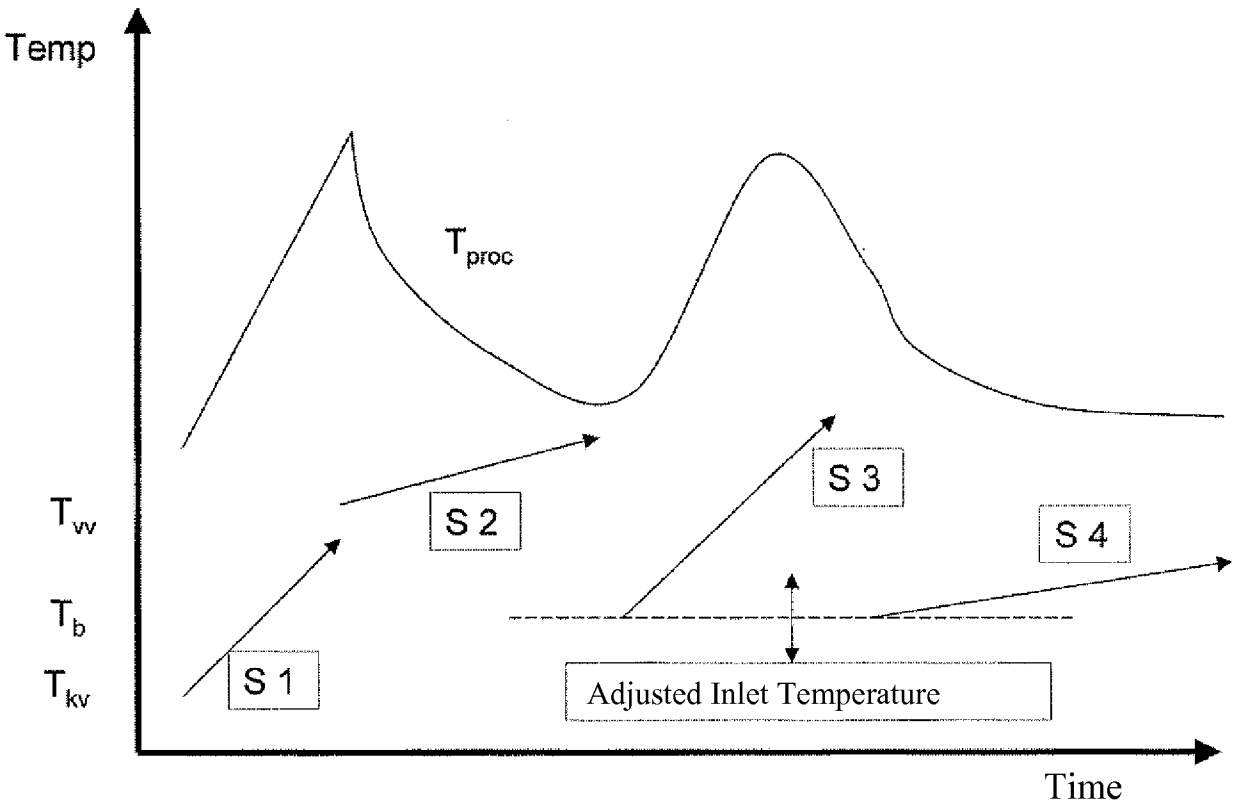
FIG. 5 depicts a temperature/time diagram for the embodiment depicted in FIG. 4.

FIG. 5 depicts a temperature/time diagram for a method according to the embodiment depicted in FIG. 4, in which a plurality of temperatures are both measured and regulated. The measured temperatures may be the inlet and outlet temperatures of the process medium from one or more sections and, for example, the inlet temperature of the heat exchanger fluids. Temperatures of incoming and outgoing heat exchanger fluids and process media may also be regulated to cover safety functions, e.g. to prevent boiling on the heat exchanger side.

What is claimed is:

1. A heat exchanger plate, comprising:

at least one heat exchanger section, each of the at least one heat exchanger section having a heat exchanger inlet and a heat exchanger outlet, and the at least one heat exchanger section being configured to flow at least one heat exchanger fluid therein in a first direction from the heat exchanger inlet to the heat exchanger outlet;

at least one process flow channel, the process flow channel having a channel inlet point and a channel outlet point, the channel inlet point and the channel outlet point defining a line oriented in a second direction, the second direction being at an angle of ninety degrees relative to the first direction;

the process flow channel having at least one of a flow plate and a reactor plate positioned proximate the at least one heat exchanger section and configured to flow a process fluid therein or thereon, and the process flow channel having a serpentine configuration between the channel inlet point and a channel outlet point;

a temperature sensor configured to measure temperature of at least one of the at least one heat exchanger fluid and the process fluid; and a regulating valve positioned in each of the heat exchanger outlets and configured to regulate flow of the heat exchanger fluid in response to a signal received from the temperature sensor.

2. The sectioned heat exchanger plate according to claim 1, in which the regulating valves are selected from the group of valves consisting of modulating valves, solenoid valves, diaphragm valves, direct-acting valves, thermostatic valves and spherical sector rotary butterfly valves.

3. The sectioned heat exchanger plate according to claim 1, wherein the serpentine configuration includes at least one of cross-flow, co-flow and counter-flow configurations of the process fluid relative to the heat exchanger fluid.

4. The sectioned heat exchanger plate according to claim 1, in which the regulating valves are connected to at least one of the heat exchanger inlets.

* * * * *